US011305574B2

(12) United States Patent
Larson

(10) Patent No.: US 11,305,574 B2
(45) Date of Patent: Apr. 19, 2022

(54) BOTTLE CARRIER TOPPER AND GIFT CARD HOLDER

(71) Applicant: American Greetings Corporation, Cleveland, OH (US)

(72) Inventor: Seth Larson, Lakewood, OH (US)

(73) Assignee: American Greetings Corporation, Cleveland, OH (US)

( * ) Notice: Subject to any disclaimer, the term of this patent is extended or adjusted under 35 U.S.C. 154(b) by 344 days.

(21) Appl. No.: 16/595,620

(22) Filed: Oct. 8, 2019

(65) Prior Publication Data

US 2021/0101400 A1 Apr. 8, 2021

(51) Int. Cl.

| | |
|---|---|
| ***B42D 15/04*** | (2006.01) |
| ***B65D 73/00*** | (2006.01) |
| ***B65D 71/52*** | (2006.01) |

(52) U.S. Cl.

CPC ..... *B42D 15/045* (2013.01); *B65D 71/0003* (2013.01); *B65D 73/0035* (2013.01)

(58) Field of Classification Search

CPC ..... B42D 15/045; B65D 71/0003; B65D 73/0035

USPC ..... 206/459.5, 139

See application file for complete search history.

(56) References Cited

U.S. PATENT DOCUMENTS

| | | | | |
|---|---|---|---|---|
| 4,197,984 | A * | 4/1980 | Hartman | B65D 75/54 229/74 |
| 4,201,299 | A * | 5/1980 | Bumgarner | B65D 33/001 206/554 |
| 6,385,874 | B1 * | 5/2002 | Tsonas | G09F 1/04 40/124.09 |
| 6,877,263 | B2 * | 4/2005 | Clark | B42D 15/045 206/308.1 |
| 9,511,893 | B2 | 12/2016 | Schewe et al. | |
| 9,988,196 | B2 * | 6/2018 | Glass | G09F 1/10 |
| 2005/0230460 | A1 * | 10/2005 | Ristau | B42D 15/042 229/92.8 |

* cited by examiner

*Primary Examiner* — Steven A. Reynolds
(74) *Attorney, Agent, or Firm* — Christine Flanagan

(57) ABSTRACT

A combined gift card holder and bottle carrier topper includes a main panel having two oblong elements separated by an elongate channel and a gift card sleeve attached to the main panel. The main panel is inserted onto a bottle carrier by placing a portion of the bottle carrier into the channel. The gift card sleeve is then located outside the bottle carrier and a portion of the bottle carrier topper is located inside the bottle carrier.

18 Claims, 3 Drawing Sheets

BOTTLE CARRIER TOPPER AND GIFT CARD HOLDER

RELATED APPLICATIONS

There are no applications related to this application.

FIELD OF THE INVENTION

The present invention is in the field of social expression products. More specifically, the invention is directed to a gift card holder than can be attached to a bottle carrier.

SUMMARY OF THE INVENTION

A gift card holder having a main panel having an open channel at a lower end thereof and a gift card sleeve operative to have a gift card inserted therein and removed therefrom, the gift card sleeve attached to the main panel. The main panel is operative to be inserted over a portion of a bottle carrier.

A gift card holder and bottle carrier topper having a topper comprising a main panel having two rectangular or oblong elements separated by an open channel and a gift card holder attached to the topper, the gift card holder comprising an open edged gift card sleeve. The topper is operative to be removably inserted onto a bottle carrier.

A gift card holder and bottle carrier topper having a bottle carrier topper and a gift card holder, a portion of which is attached to the bottle carrier topper. The bottle carrier topper is operative to be removably inserted onto a bottle carrier.

DETAILED DESCRIPTION OF PREFERRED AND ALTERNATE EMBODIMENTS

The bottle carrier topper and gift card holder 10 of the present disclosure and related inventions provides a way to gift a gift card to a recipient along with a 6-pack of bottled beverages. The bottle carrier topper and gift card holder 10 provides a decorative aspect to a bottle carrier 12 which provides a more festive effect when gifting a group of beverages to a recipient. It also provides a backer 10A to which a gift card holder 10B is attached so that a gift card may be gifted along with the bottled beverages. While the term "6-pack" is used herein to describe the bottle carrier 12, the bottle carrier 12 may include any number of cavities into which bottles may be inserted, such as less than 6 or greater than 6. The bottle carrier topper and gift card holder 10 of the present invention may be attached to any bottle carrier 12, regardless of the number of cavities therein into which bottles 16 may be inserted. Also, while the term "bottle carrier" is used throughout this specification, the carrier may alternately be used to carry cans or other containers which are operative to house and carry liquid or other contents. The terms "6-pack" and "bottle" are used because this is the general way these products are typically known. The bottle carrier topper and gift card holder 10 of the present disclosure and related inventions, in one embodiment, is made from cardstock. Other materials may be used, including, but not limited to: cardboard or plastic, as long as the material has sufficient rigidity to remain upright when inserted into a bottle carrier 12 and to house the gift card. The cardstock, or other material, may have printing thereon featuring photos, pictures, drawings, text or any other printable matter. The cardstock may additionally be adorned with embellishments, including, but not limited to gems, googly eyes, faux fur, or any other such decorative embellishment.

Figure 2:
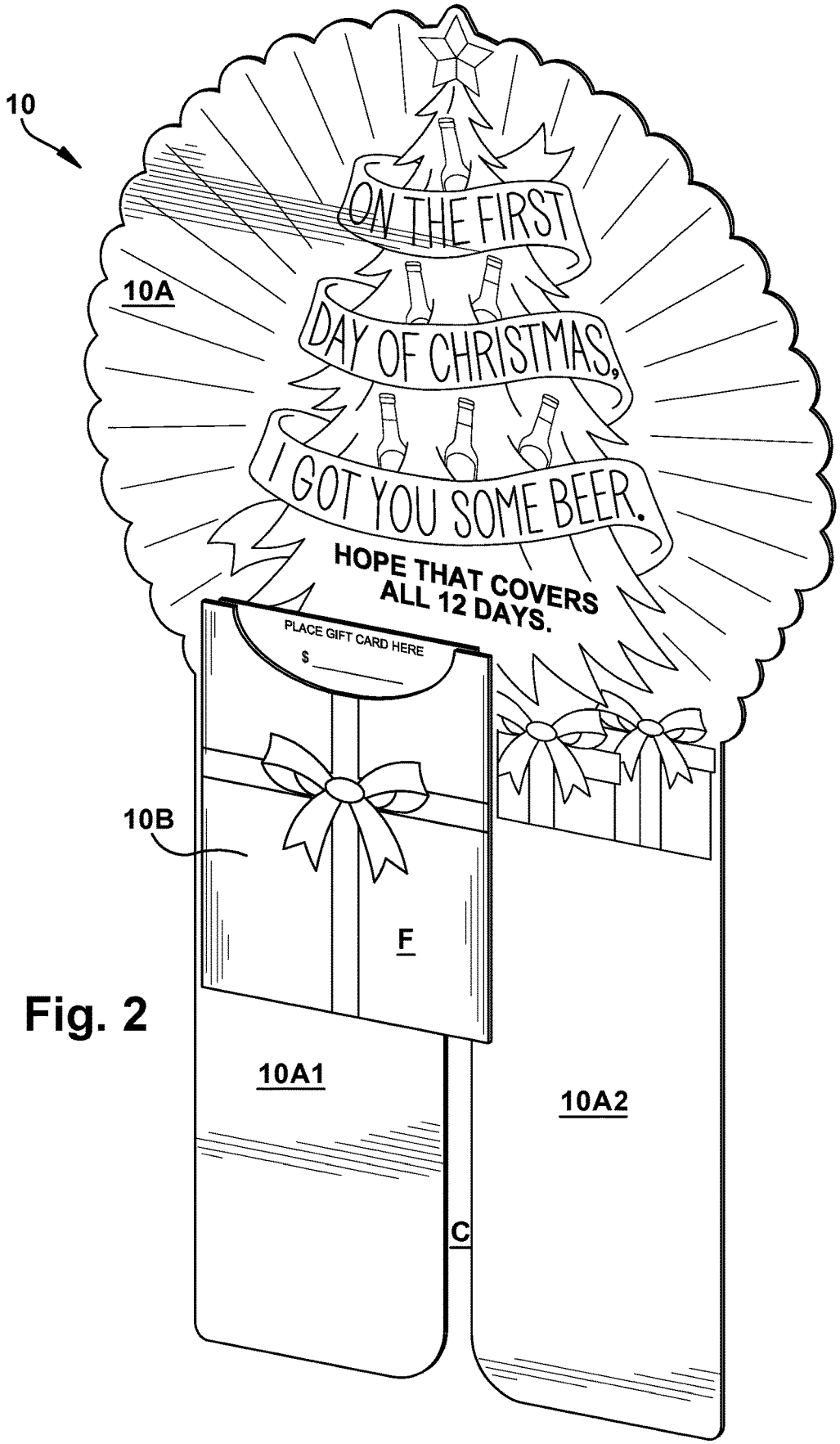
FIG. 2 is a perspective view of the bottle carrier topper and gift card holder of the present invention.
Figure 3:
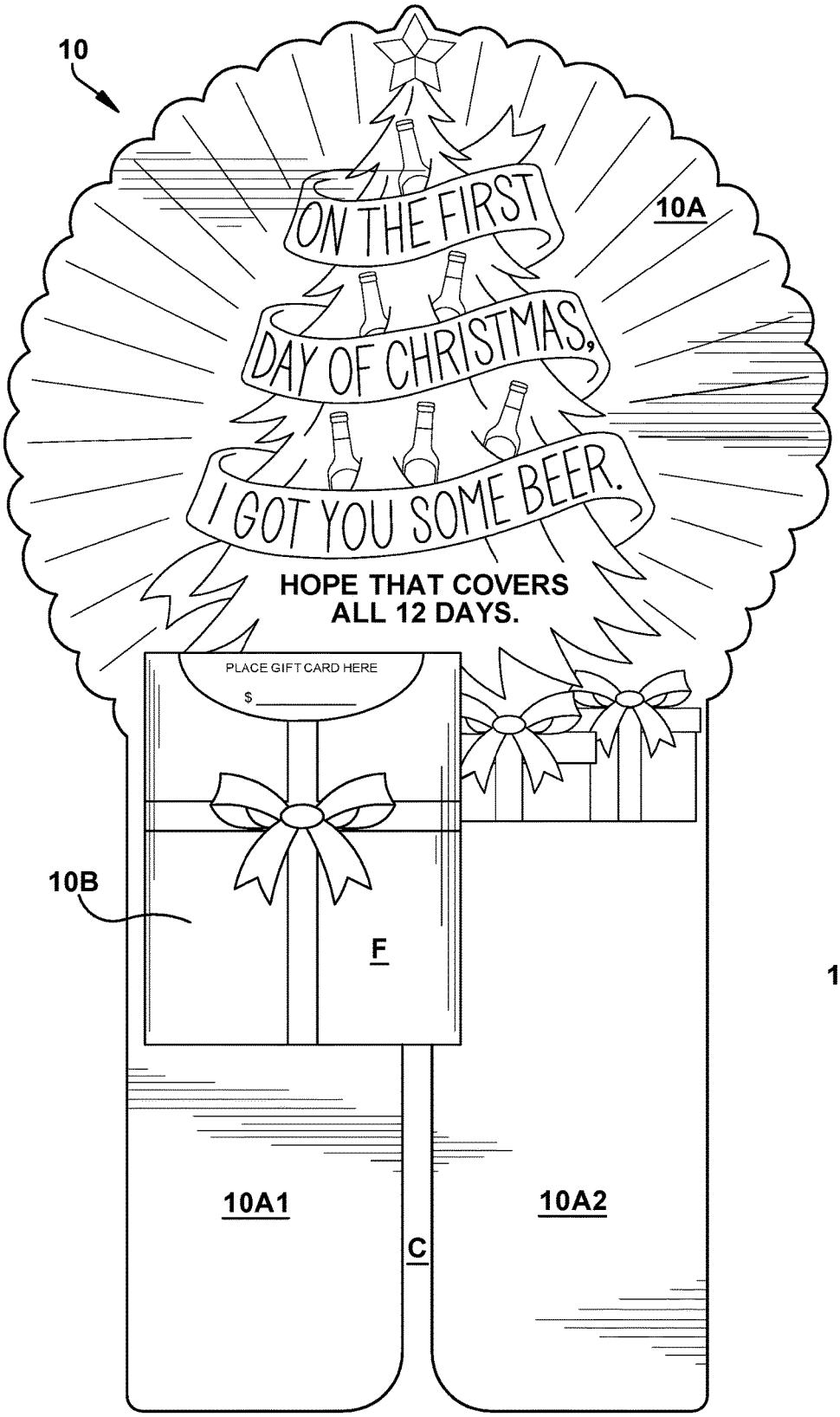
FIG. 3 is a front view of the bottle carrier topper and gift card holder of FIG. 2.
Figure 4:
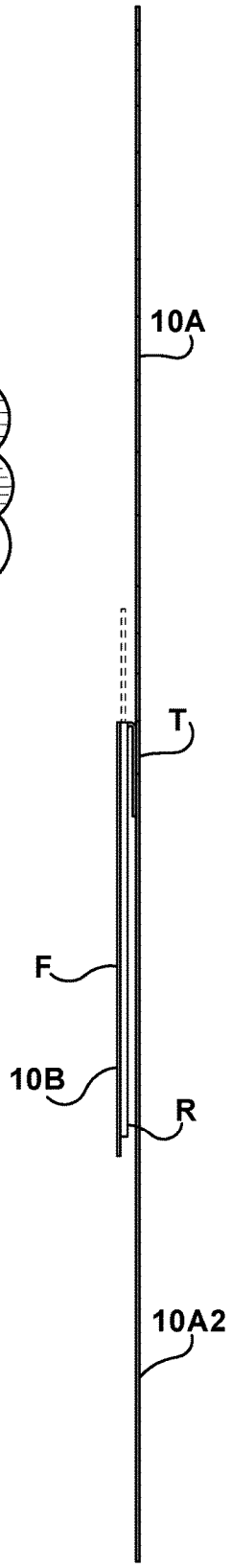
FIG. 4 is a right side view of the bottle carrier topper and gift card holder of FIG. 2.

The bottle carrier topper and gift card holder 10 includes a main panel 10A and a gift card holder 10B attached thereto. The main panel 10A contains an upper portion and a lower portion. The upper portion may be made into an shape. For example, in the embodiment shown in the figures, the upper portion of the main panel 10A has a substantially circular shape with scalloped edges. The lower portion of the main panel contains two generally rectangular or oblong elements 10A1, 10A2 which are separated by an elongate channel C, as shown in FIGS. 2 and 3. In one embodiment, both of the rectangular or oblong elements 10A1, 10A2 of the lower portion of the main panel 10A are contiguous with the upper portion of the main panel 10A. In other embodiments, they may be separate elements which are attached or secured to the upper portion of the main panel 10A using any attachment mechanism. The main panel 10A serves as the "topper" or decorative aspect which, as noted above, may contain photos, drawings, pictures or a text greeting printed thereon. The printed matter may contain a greeting suitable to an event, such as a birthday, Christmas, or other holiday or special event. For example, the embodiment shown in the figures contains a Christmas Tree printed thereon with a suitable message indicating the contents of a bottle carrier 12. The main panel 10A may also contain unprinted space intended for the gift giver to insert his/her signature or to include a personal message.

The gift card holder portion 10B of the bottle carrier topper and gift card holder 10 of the present disclosure and related inventions, may be an open-topped sleeve, as shown in the figures, which is operative to have a standard sized gift card inserted therein and removed therefrom. In one embodiment, the sleeve 10B is made from a single contiguous piece of material, having a front portion F, a rear portion R and a tab portion T. The front F and rear R portions may be attached along three sides thereof (typically along the lower and right and left edges, leaving the upper edge open for insertion and removal of the gift card, although one of the other three edges may be left open for this purpose) using glue, staples or any attachment mechanism. The attachment of three edges of the front F and rear R portions of the gift card holder 10B create a cavity therebetween with an open edge for insertion and removal of a gift card. While the term "gift card" is used to describe the item to be inserted into the open ended sleeve, the gift giver may alternately insert cash money, a check, a gift certificate, or other such gift item. Also, while the gift card holder portion 10B is described as being an open sided sleeve, the gift card holder 10B may be a closed cavity, having a flap over the open ended side into which the gift card is inserted and removed. The flap may or may not be attached to the sleeve. Example attachment methods for attaching the flap to the sleeve include, but are not limited to: glue, a snap, a button, a zipper, Velcro® or other such attachment mechanism. Alternatively, a flap may be inserted to tucked into the sleeve to create a closed cavity. As an alternative to a gift card sleeve, the gift card holder may be an envelope, pocket or other construct operative to have a gift card inserted therein and removed therefrom. The tab portion T of the gift card holder 10B, in one embodiment, may extend upward from the rear portion R of the gift card sleeve 10B and be folded downward along a fold line to lie in a stacked or parallel arrangement to the front F and rear R portions of the sleeve 10B. The tab portions T is then attached, via glue or otherwise, to the main portion 10A of the bottle carrier topper and gift card holder 10. This configuration allows the gift card holder portion 10B to sit outside a bottle carrier 12 when the bottle carrier topper and gift card holder 10 is inserted onto the bottle carrier 12.

Figure 1:
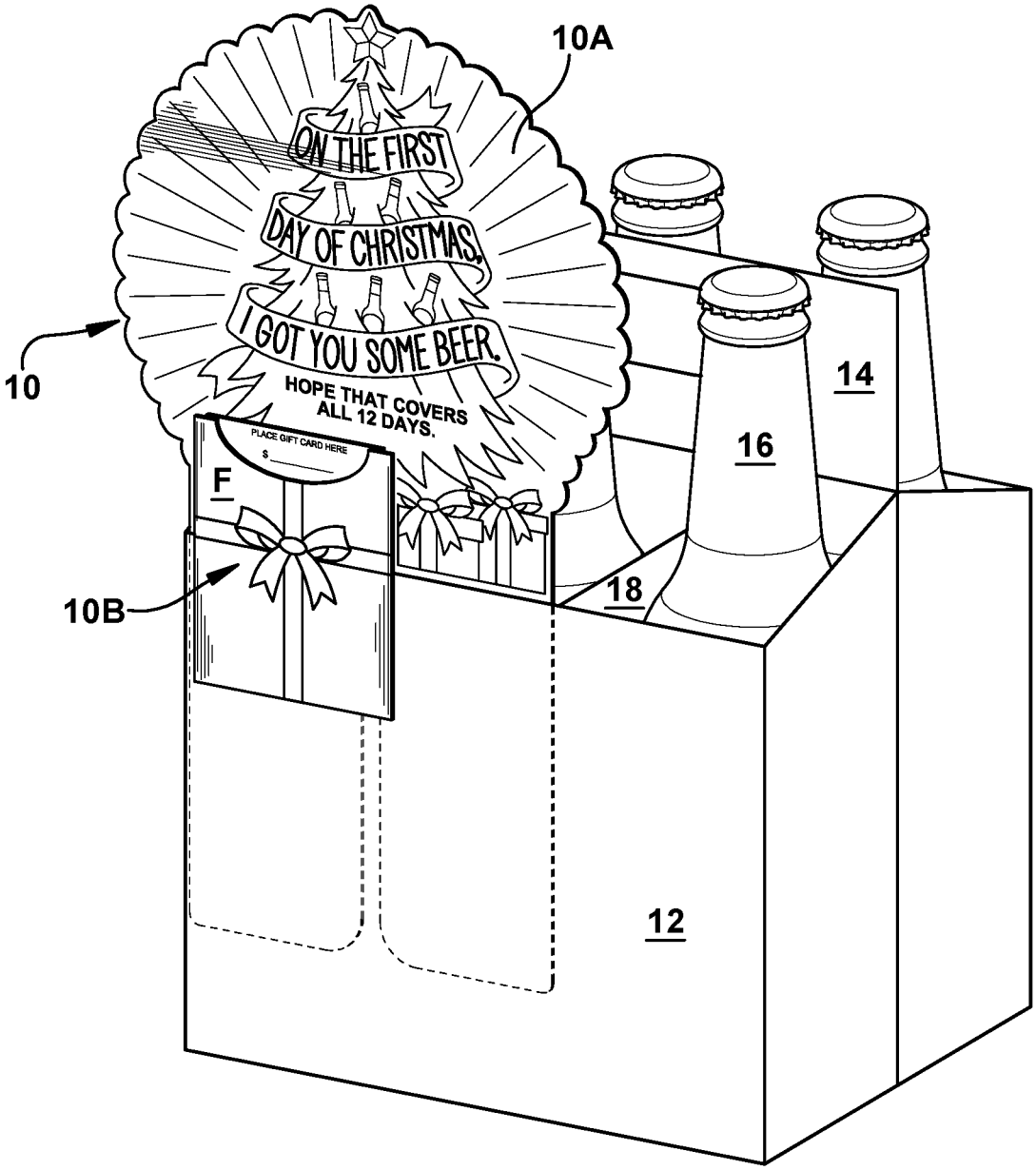
FIG. 1 is a perspective view of the bottle carrier topper and gift card holder of the present invention, attached to a bottle carrier.

In use, the bottle carrier topper and gift card holder 10 of the present disclosure and related inventions, is inserted onto a bottle carrier 12, as shown in FIG. 1. A typical bottle carrier typically consists of a four-sided container having a floor, an open top and a handle portion 14, as shown in the Figures. The carrier 12 additionally contains dividers 18 which separate the carrier 12 into a specific number of cavities or spaces (typically six although any other number of cavities may be used) into which bottles 16 (or other such container) may be inserted and removed. The handle portion 14 extends upward from the center of the carrier 12, as shown in FIG. 1. An upper portion or neck of the bottles 16 (or other such container) are visible above the cavities into which they are contained. The main portion 10A of the bottle carrier topper and gift card holder 10 can be inserted onto a bottle carrier 12 by placing it over the top of one of the dividers 18 which divide the carrier 12 into separate cavities or openings. The divider 18 is inserted to the channel C between the two rectangular or oblong elements 10A1, 10A2 of the main panel 10A of the bottle carrier topper and gift card holder 10. For example, as shown in the FIG. 1, the two rectangular or oblong elements 10A1, 10A2 on the main panel 10A are inserted over the divider 18 between the two left-most cavities or spaces (into which bottles 16 are contained) of the bottle carrier 12. A portion of the bottle carrier 12 is located between the gift card sleeve 10B and the main panel 10A.

The bottle topper and gift card holder 10 of the present disclosure and related inventions provides a novel way for gift givers to gift a selection of beer, wine or other beverage along with a gift card. It provides a way for gift givers to make the gifting of a gift card more exciting and make the gifting of a selection of beverages more festive and provide a more thoughtful way of gifting both items which may otherwise seem impersonal.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A gift card holder comprising:

a main panel having an open channel at a lower end thereof;

a gift card sleeve operative to have a gift card inserted therein and removed therefrom;

a tab having a first portion and a second portion attached along a fold line; wherein the first portion of the tab is attached to the main panel and the second portion of the tab is attached to the gift card sleeve;

wherein the main panel is operative to be inserted over a portion of a bottle carrier.

2. The gift card holder of claim 1, wherein the gift card sleeve has an open edge where a gift card may be inserted into and removed therefrom.

3. The gift card holder of claim 1, wherein the main panel contains a greeting printed thereon.

4. The gift card holder of claim 1, wherein the gift card sleeve contains a greeting printed thereon.

5. The gift card holder of claim 1, wherein when the gift card holder is inserted over a portion of a bottle carrier, the main panel extends above the bottle carrier.

6. The gift card holder of claim 1, wherein when the gift card holder is inserted over a portion of the bottle carrier, a portion of the bottle carrier is located between the main panel and the gift card sleeve.

7. A gift card holder and bottle carrier topper comprising:

a topper comprising a main panel having two rectangular or oblong elements separated by an open channel, wherein each side of the open channel are parallel to one another;

a gift card holder attached to the topper above the open channel, the gift card holder comprising an open edged gift card sleeve;

wherein the topper is operative to be removably inserted onto a bottle carrier.

8. The gift card holder and bottle carrier topper of claim 7, wherein when the topper is inserted onto a bottle carrier, a portion of the bottle carrier is located between the topper and the gift card holder.

9. The gift card holder and bottle carrier topper of claim 7, wherein the topper and the gift card holder have a greeting printed thereon.

10. The gift card holder and bottle carrier topper of claim 7, wherein when the topper is inserted onto a bottle carrier, a portion of the topper extends above the bottle carrier.

11. The gift card holder and bottle carrier topper of claim 7, wherein a gift card is contained within the gift card holder.

12. The gift card holder and bottle carrier topper of claim 7, wherein when the topper is inserted onto a bottle carrier, the gift card holder is located outside of the bottle carrier.

13. The gift card holder and bottle carrier topper of claim 7, wherein when the topper is inserted onto a bottle carrier, a portion of the topper is located inside the bottle carrier.

14. The gift card holder and bottle carrier topper of claim 7, wherein the gift card holder contains a tab attached thereto.

15. The gift card holder and bottle carrier topper of claim 14, wherein the gift card holder is attached to the topper via the tab.

16. A gift card holder and bottle carrier topper comprising:

a bottle carrier topper, a portion of the bottle carrier topper comprising two oblong portions, a first oblong portion and second oblong portion parallel to the first oblong portion, the first and second oblong portions being separated by an elongate U-shaped channel;

a gift card holder;

a tab, a first portion of the tab being attached to the bottle carrier topper and a second portion of the tab being attached to the gift card holder;

wherein the bottle carrier topper is operative to be removably inserted onto a bottle carrier.

17. The gift card holder and bottle carrier topper of claim 16, wherein the bottle carrier topper is inserted onto a bottle carrier by inserting a portion of the bottle carrier into the channel.

18. The gift card holder and bottle carrier topper of claim 16, wherein when the bottle carrier topper is inserted onto a bottle carrier, the gift card holder is located outside of the bottle carrier and a portion of the bottle carrier topper is located inside of the bottle carrier.

* * * * *